US010689164B2

(12) United States Patent
Price

(10) Patent No.: US 10,689,164 B2
(45) Date of Patent: Jun. 23, 2020

(54) CONTAINER WITH HEAT-SEALED COMPOSITE PLASTIC AND METAL SCREW CLOSURE

(71) Applicant: Sonoco Development, Inc., Hartsville, SC (US)

(72) Inventor: Trevor Price, North Canton, OH (US)

(73) Assignee: SONOCO DEVELOPMENT, INC., Hartsville, SC (US)

( * ) Notice: Subject to any disclaimer, the term of this patent is extended or adjusted under 35 U.S.C. 154(b) by 92 days.

(21) Appl. No.: 14/147,164

(22) Filed: Jan. 3, 2014

(65) Prior Publication Data

US 2015/0191279 A1 Jul. 9, 2015

(51) Int. Cl.

| | |
|---|---|
| ***B65D 41/34*** | (2006.01) |
| ***B65D 53/04*** | (2006.01) |
| ***B65D 41/04*** | (2006.01) |
| ***B65D 51/14*** | (2006.01) |

(52) U.S. Cl.

CPC ..... *B65D 41/3428* (2013.01); *B65D 41/045* (2013.01); *B65D 51/145* (2013.01); *B65D 53/04* (2013.01)

(58) Field of Classification Search

CPC ... B65D 41/3428; B65D 51/145; B65D 53/00
USPC ..... 206/350; 215/252
See application file for complete search history.

(56) References Cited

U.S. PATENT DOCUMENTS

| | | | |
|---|---|---|---|
| 4,051,972 | A | 10/1977 | Botkin |
| 4,418,834 | A | 12/1983 | Helms et al. |
| 4,473,163 | A | 9/1984 | Geiger |
| 4,679,696 | A | 6/1987 | Bonnenfant et al. |
| 4,880,127 | A | 11/1989 | Doi |

(Continued)

FOREIGN PATENT DOCUMENTS

| | | | |
|---|---|---|---|
| DE | 8903067 | U1 | 6/1989 |
| DE | 44 04 069 | A1 | 8/1995 |

(Continued)

OTHER PUBLICATIONS

International Search Report and Written Opinion for International Application No. PCT/US2014/059854 dated Jan. 14, 2015.

(Continued)

*Primary Examiner* — Anthony D Stashick
*Assistant Examiner* — Raven Collins
(74) *Attorney, Agent, or Firm* — Nelson Mullins Riley & Scarborough LLP

(57) ABSTRACT

An assembly of a container and a closure. The container has a rim defining an upper sealing surface formed of a heat-sealable material, and an external screw thread extending helically along an outer surface at a location spaced below the rim. The closure includes a screw cap assembled with a separately formed disk inserted in the cap, the closure defining an internal screw thread for attaching the closure to the container when the closure is rotated in a first direction. The disk is constructed of a laminated metal having an upper metal layer and a lower heat-sealable layer affixed to an underside of the metal layer. A heat seal between the heat-sealable layer of the disk and the upper sealing surface of the rim affixes the disk to the rim such that the disk seals closed the open top end of the container.

6 Claims, 4 Drawing Sheets

(56) References Cited

U.S. PATENT DOCUMENTS

| | | | | |
|---|---|---|---|---|
| 5,009,324 | A | 4/1991 | Ochs | |
| 5,044,776 | A | 9/1991 | Schramer et al. | |
| 5,062,538 | A | 11/1991 | Ochs | |
| 5,346,082 | A | 9/1994 | Ochs et al. | |
| 5,450,973 | A | 9/1995 | Ellis et al. | |
| 5,819,965 | A | 10/1998 | King et al. | |
| 5,839,592 | A | 11/1998 | Hayes | |
| 6,112,923 | A | 9/2000 | Ma | |
| 6,220,466 | B1 | 4/2001 | Hayes et al. | |
| 6,276,543 | B1 | 8/2001 | German et al. | |
| 6,277,478 | B1 | 8/2001 | Kurita et al. | |
| 6,484,896 | B2 | 11/2002 | Ma | |
| 6,766,916 | B2 | 7/2004 | Ma | |
| 6,874,647 | B2 | 4/2005 | Bloom et al. | |
| 6,974,046 | B2 | 12/2005 | Shenkar | |
| 7,014,060 | B2 * | 3/2006 | Richardson | B65D 41/08 220/288 |
| 7,134,565 | B1 | 11/2006 | Wan et al. | |
| 7,175,039 | B2 * | 2/2007 | German | B65D 41/3423 215/252 |
| 7,445,130 | B2 | 11/2008 | Bosl et al. | |
| 7,549,547 | B2 | 6/2009 | Herr et al. | |
| 7,784,629 | B2 | 8/2010 | German et al. | |
| 8,251,236 | B1 | 8/2012 | Robinson et al. | |
| 2003/0098286 | A1 | 5/2003 | Bloom et al. | |
| 2007/0187352 | A1 * | 8/2007 | Kras | B65D 41/0442 215/276 |
| 2010/0003109 | A1 | 1/2010 | Ramsey et al. | |
| 2011/0011866 | A1 * | 1/2011 | Dunwoody | B65D 41/02 220/310.1 |
| 2011/0220651 | A1 | 9/2011 | Rho | |
| 2012/0048825 | A1 * | 3/2012 | Averett | B65B 7/2835 215/232 |
| 2012/0067892 | A1 * | 3/2012 | Velmer | B65D 41/3428 220/268 |
| 2012/0074157 | A1 | 3/2012 | Dunwoody | |
| 2014/0376836 | A1 | 12/2014 | Schieber | |

FOREIGN PATENT DOCUMENTS

| | | | |
|---|---|---|---|
| EP | 1 686 070 | A1 | 8/2006 |
| FR | 2 886 275 | A1 | 12/2006 |
| GB | 2 052 455 | A | 1/1981 |
| GB | 2147564 | A | 5/1985 |
| WO | WO 92/19506 | | 11/1992 |

OTHER PUBLICATIONS

Office Action for corresponding European Patent Application No. 14 792 932.7 dated Jan. 18, 2018.

* cited by examiner

CONTAINER WITH HEAT-SEALED COMPOSITE PLASTIC AND METAL SCREW CLOSURE

BACKGROUND OF THE INVENTION

The present disclosure relates to screw caps for containers.

Composite plastic and metal screw caps have been used for some types of containers, as exemplified by U.S. Pat. No. 5,346,082. The closure of the '082 patent includes an internally threaded plastic closure that goes over a metal disc. The disk is not attached to the plastic closure but is loosely retained therein. When the plastic closure is screwed onto the container, the metal disk is compressed against the rim of the container. A bead of plastisol sealant on the underside of the disk is compressed between the disk and the container rim to seal the container closed. This type of closure is sometimes used for retort containers.

It has been found that during retort processing, the seal can be breached because the plastisol sealant's ability to seal the container depends on a continuous compressive force from the plastic cap, which can be difficult to maintain.

BRIEF SUMMARY OF THE DISCLOSURE

The present disclosure describes a container assembly comprising:

- a container having an open top end, the top end defining a rim, the rim defining an upper sealing surface formed of a heat-sealable material, the top end further defining an external screw thread extending helically along an outer surface of the top end at a location spaced below the rim;
- a closure comprising a screw cap assembled with a separately formed disk inserted in the cap, the cap defining an internal screw thread extending helically along an inner surface of the cap and engageable with the external screw thread on the top end of the container for attaching the closure to the container when the cap is rotated in a first direction,
- the disk being constructed of a laminated metal having an upper metal layer and a lower heat-sealable layer affixed to an underside of the metal layer; and
- a heat seal between the heat-sealable layer of the disk and the upper sealing surface of the rim, the heat seal affixing the disk to the rim such that the disk seals closed the open top end of the container.

In one embodiment the cap further comprises a projection extending radially inwardly from the inner surface of the cap, the projection being located such that, with the closure rotated fully in the first direction to attach the closure to the container, the projection is below the rim but above the external screw thread. The projection extends below and radially inwardly past an outer periphery of the disk to keep the disk captive within the cap.

The projection can be structured and arranged so that when the closure is rotated in a second direction to unscrew the closure from the container, the projection exerts an upward force on the disk causing the heat seal to be broken to allow the disk to be detached from the rim.

Various configurations of projections are possible. In one embodiment, the projection is structured and arranged to exert the upward force on less than a full circumference of the disk at any given instant in time. For example, in one particular embodiment, the projection is structured and arranged to exert the upward force on a localized region of the disc's circumference and such that the localized region progresses around the circumference in the second direction as the closure is unscrewed.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
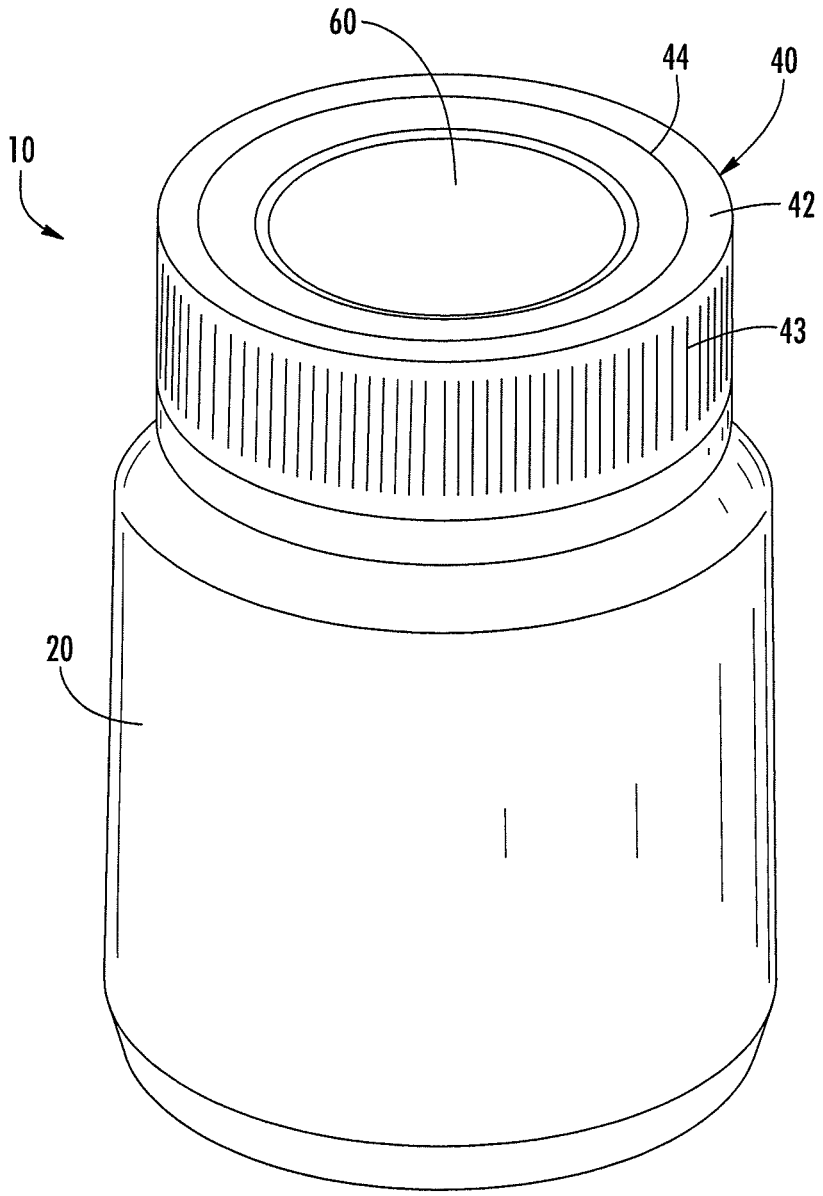
FIG. 1 is a perspective view of a container in accordance with one embodiment of the invention.
Figure 2:
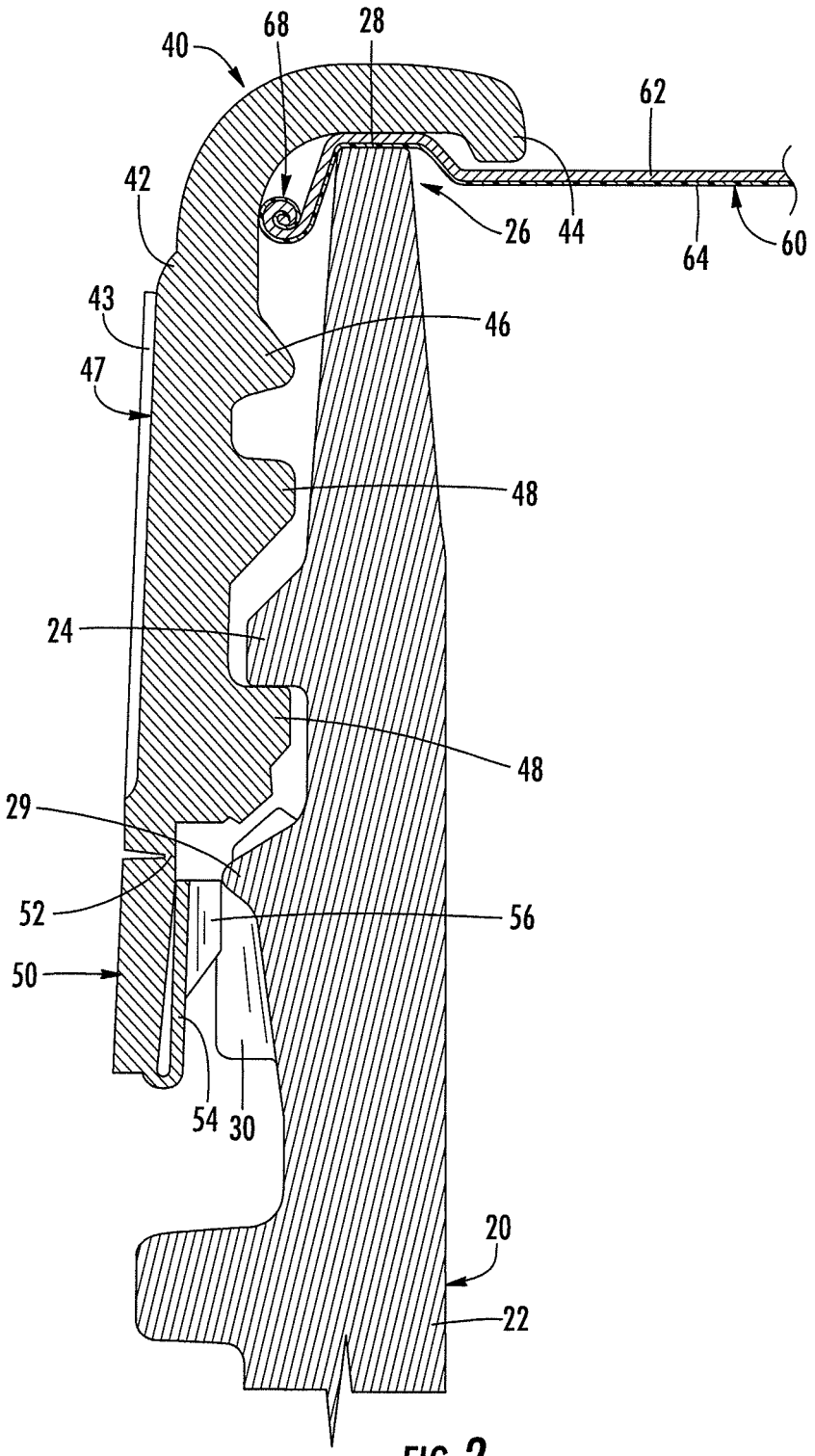
FIG. 2 is a cross-sectional view through a region of the closure and container neck in accordance with one embodiment of the invention.

A container assembly 10 in accordance with one embodiment of the invention is depicted in FIGS. 1 through 4. The container assembly includes a container 20 and a closure 40 that is attachable to and detachable from the container. The container 20 can comprise any of various materials and can be configured in any of various shapes and sizes. Conveniently the container may be a blow-molded or injection-molded plastic bottle. As best seen in FIG. 2, the container 20 includes a neck or finish 22 at the top end of the container. The finish is configured for receiving the closure 40. In particular, the finish defines an external screw thread 24 for engaging the cap. At the upper end of the finish is a rim 26 whose upper surface 28 defines a sealing surface formed of a heat-sealable material. In the case of a molded plastic bottle, for example, the material of which the bottle is molded may be a heat-sealable material, in which case the upper sealing surface 28 is automatically formed of a heat-sealable material. Alternatively, if the bottle is formed of a non-heat-sealable material, then a separate heat-sealable material may be affixed to the upper surface of the rim to form the upper sealing surface 28.

The finish 22 also defines a cam 29 and series of ratchets 30 on its exterior side, spaced below the thread 24, for purposes described below.

The closure 40 is a two-piece assembly comprising a molded plastic annular ring or cap 42 and a cover or insert disk 60 that is received in the cap 42 below an inwardly projecting lip or overhand 44 of the cap. The disk is axially movable within the cap, being retained from below by an inwardly extending projection 46 on the cap. The cap includes a skirt 47 whose inner surface has a screw thread 48 that engages the corresponding screw thread 24 on the container finish. On its outside surface the skirt 47 has ribs 43 to aid in gripping and turning the cap. At a lower end of the skirt is a tamper-evident band 50 integrally attached to the skirt by frangible bridges 52. Along its lower edge the band 50 has a band retainer that comprises a plurality of hinged angularly spaced tabs or spring fingers 54. Each finger 54 is hinged to the band and presents ratchets 56. Alternate adjacent fingers are separated from one another by slots or gaps (not shown). When the cap 42 is molded the fingers 54 are in a downwardly extending "as molded" position but are subsequently folded upwardly to the inverted "use" position (FIG. 2) in which the ratchets 56 are facing inwardly for engaging the corresponding ratchets 30 formed on the container finish. When the closure 40 is being secured to the container, the hinged connection of the ratchet fingers 54 to the band 50 provides a spring bias on the fingers, urging them inwardly toward the container. The fingers yield outwardly to pass over a respective cam 29 on the container finish, which guides them to seat with the ratchet sets 30 on the finish.

Figure 3:
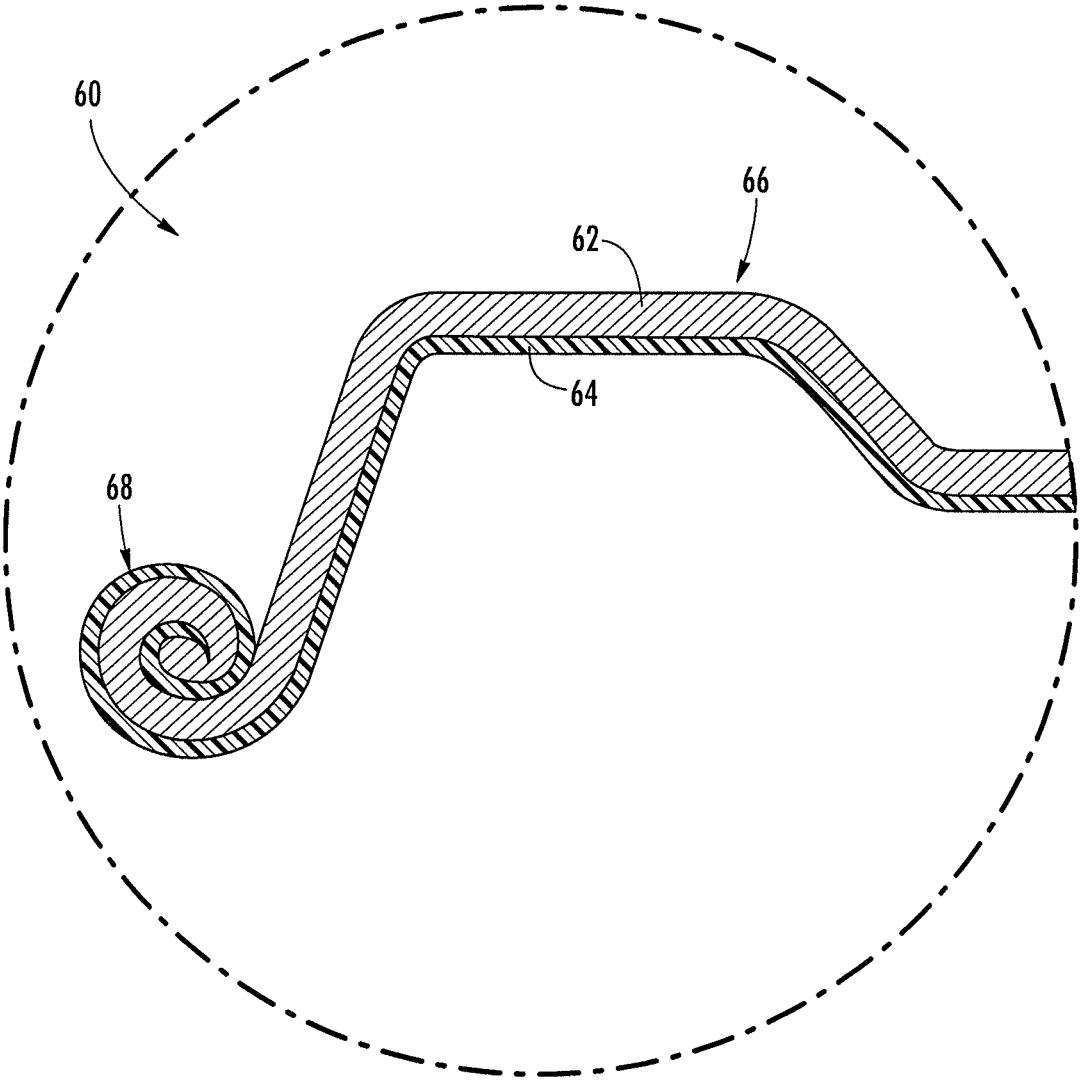
FIG. 3 is a magnified cross-sectional view of an outer periphery of the laminated metal disk used in the closure of FIG. 2.
Figure 4:
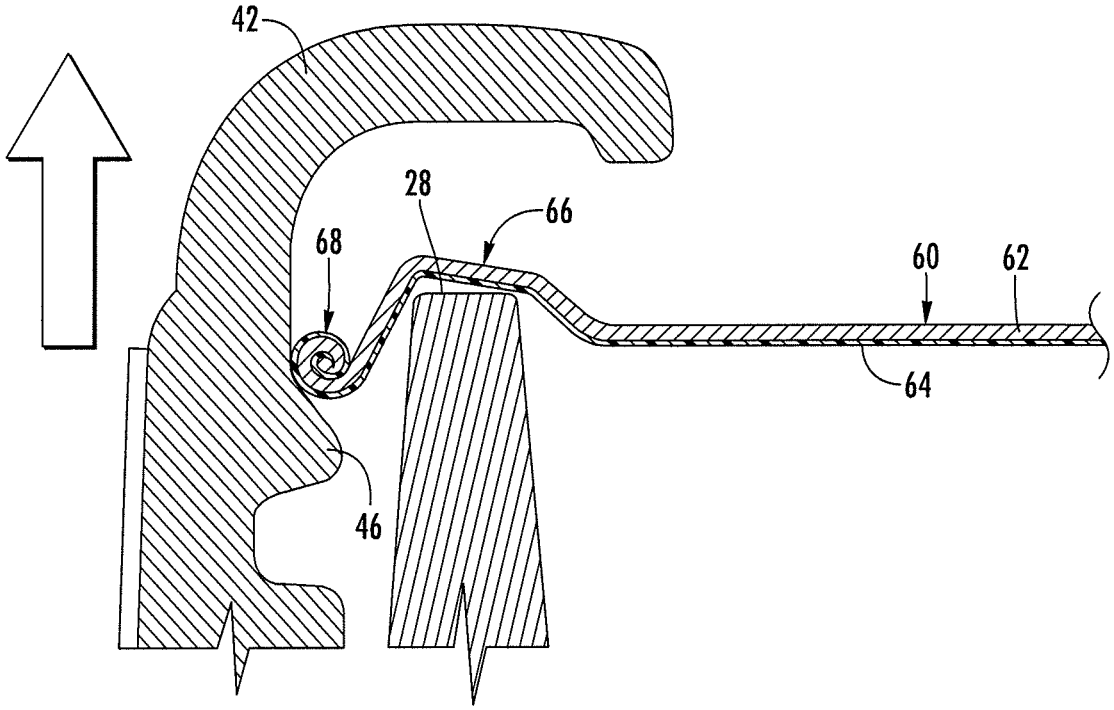
FIG. 4 is a view similar to FIG. 2, illustrating how unscrewing the closure lifts the metal disk and breaks the heat seal with the container rim.

With reference to FIG. 3, the metal disk 60 is formed of a laminated metal material comprising a metal layer 62 to the underside of which a heat-sealable layer 64 is laminated. A starting flat blank of such laminated metal material is formed by a suitable process (e.g., in a die press) to have a raised peripheral bead 66 and, radially outwardly of the bead, an outward curl 68.

In accordance with the invention, sealing of the container by the closure 40 is accomplished by first screwing the closure onto the container so that, as shown in FIG. 2, the heat-sealable layer 64 of the disk is in contact with the upper sealing surface 28 of the container rim 26, and then heating the region of the peripheral bead 66 of the disk so as to cause softening and fusion of the heat-sealable layer 64 and sealing surface 28 to join them together by a heat seal.

When the cap 42 is unscrewed to remove the closure, the engagement between the closure ratchets 56 and the container ratchets 30 causes the tamper-evident band 50 to be broken away from its attachment to the skirt of the closure (i.e., the bridges 52 break). Furthermore, the projection 46 on the cap engages the curl 68 on the disk such that further unscrewing of the cap 42 causes the projection 46 to exert upward force on the disk 60 at the location of the projection, causing the heat seal to be broken to allow the disk to be detached from the rim.

In some embodiments the projection 46 is structured and arranged to exert the upward force on less than a full circumference of the disk 60 at any given instant in time. For example, in one embodiment the projection is structured and arranged to exert the upward force on a localized region of the disc's circumference and such that the localized region progresses around the circumference as the closure is unscrewed.

A significant advantage of the invention is that the hermetic seal between the disk 60 and the container 20 does not depend on maintaining a continuous compressive force on the disk by the cap 42, which is the case with conventional closures of this general type having a compressible gasket, such as the closure described in U.S. Pat. No. 5,346,082. Rather, the seal is accomplished by heat sealing.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A container assembly comprising:

a container having an open top end, the top end defining a rim, the rim defining an upper sealing surface formed of a heat-sealable material, the top end further defining an external screw thread extending helically along an outer surface of the top end at a location spaced below the rim;

a closure comprising a screw cap formed of plastic ring assembled with a separately formed disk inserted in the cap, the cap defining an internal screw thread extending helically along an inner surface of the cap and engageable with the external screw thread on the top end of the container for attaching the closure to the container when the closure is rotated in a first direction, the cap further comprising an inwardly projecting lip, the disk being constructed of a laminated metal having an upper metal layer and a lower heat-sealable layer affixed to an underside of the metal layer and further comprising a raised peripheral bead and a curl located radially outward from the raised peripheral bead, wherein the raised peripheral bead of the disk is located between the inwardly projecting lip and an outer surface of the cap; and a heat seal between the heat-sealable layer of the disk and the heat-sealable material of the upper sealing surface of the rim, the heat seal affixing the disk to the rim such that the disk seals closed the open top end of the container without depending on a continuous compressive force of the disk by the cap, wherein the cap further consists of a single projection extending inwardly from the cap, wherein the projection does not extend fully circumferentially within the cap, and wherein the projection is structured and arranged such that as the cap is unscrewed, the projection exerts an upward force on a localized region of the disk's circumference and such that the localized region progresses around the circumference in the second direction as the closure is unscrewed, causing the heat seal to be broken between the disk and the upper sealing surface of the rim at the localized region to allow the disk to be detached from the rim.

2. The container assembly of claim 1, the projection being located such that, with the closure rotated fully in the first direction to attach the closure to the container, the projection is below the rim but above the external screw thread, and wherein the projection extends below and inwardly past an outer periphery of the disk to keep the disk captive within the cap.

3. The container assembly of claim 1, wherein the cap comprises a ring that is open at bottom and top ends thereof, the top end of the ring defining an overhang portion that lies above a top surface of the disk around the circumference thereof.

4. A container assembly comprising:

a container having an open top end, the top end defining a rim, the rim defining an upper sealing surface formed of a heat-sealable material, the top end further defining an external screw thread extending helically along an outer surface of the top end at a location spaced below the rim;

a closure comprising a screw cap formed of plastic ring assembled with a separately formed disk inserted in the cap, the cap defining an internal screw thread extending helically along an inner surface of the cap and engageable with the external screw thread on the top end of the container for attaching the closure to the container when the closure is rotated in a first direction, the cap further comprising an inwardly projecting lip, the disk being constructed of a laminated metal having an upper metal layer and a lower heat-sealable layer affixed to an underside of the metal layer and further comprising a raised peripheral bead and a curl located radially outward from the raised peripheral bead, wherein the raised peripheral bead of the disk is located between the inwardly projecting lip and an outer surface of the cap; and a heat seal between the heat-sealable layer of the disk and the heat-sealable material of the upper sealing surface of the rim, the heat seal affixing the disk to the rim such that the disk seals closed the open top end of the container without depending on a continuous compressive force of the disk by the cap, wherein the cap further consists of a single projection extending inwardly from the cap, wherein the projection is sized such that it comprises less than the full circumference of the cap, and wherein the projection is structured and arranged such that as the cap is unscrewed, the projection engages the curl on the disk and exerts upward force on a localized region of the disk's circumference such that the localized region progresses around the circumference in the second direction as the closure is unscrewed, causing the heat seal to be broken between the disk and the upper sealing surface of the rim at the localized region to allow the disk to be detached from the rim.

5. The container assembly of claim 4, the projection being located such that, with the closure rotated fully in the first direction to attach the closure to the container, the projection is below the rim but above the external screw thread, and wherein the projection extends below and inwardly past an outer periphery of the disk to keep the disk captive within the cap.

6. The container assembly of claim 4, wherein the cap comprises a ring that is open at bottom and top ends thereof, the top end of the ring defining an overhang portion that lies above a top surface of the disk around the circumference thereof.

* * * * *